United States Patent [19]

Mills et al.

[11] 4,127,025

[45] Nov. 28, 1978

[54] CIGARETTE TESTING

[75] Inventors: John A. Mills; Desmond W. Molins, both of London, England

[73] Assignee: Molins Limited, England

[21] Appl. No.: 777,460

[22] Filed: Mar. 14, 1977

[30] Foreign Application Priority Data

Mar. 16, 1976 [GB] United Kingdom ..... 10596/76

[51] Int. Cl.[2] ..... G01N 15/08

[52] U.S. Cl. ..... 73/38

[58] Field of Search ..... 73/37, 38; 131/10 A

[56] References Cited

U.S. PATENT DOCUMENTS 3,395,570 8/1968 Kocholski ..... 73/38 X 3,769,832 11/1973 Baier ..... 73/38 X 3,967,491 7/1976 Preston ..... 73/38 X

FOREIGN PATENT DOCUMENTS 1,036,889 7/1966 United Kingdom.

1,195,682 6/1970 United Kingdom.

*Primary Examiner*—Charles Gorenstein

*Attorney, Agent, or Firm*—Craig & Antonelli

[57] ABSTRACT

In the manufacture of ventilated filter-tipped cigarettes the continuous wrapper web for the filter rod is formed, at least at longitudinally spaced positions, with perforations or semi-perforations to allow a significant air flow into the filters of the finished cigarettes.

The invention includes an apparatus for testing such ventilated cigarettes to check that the degree of ventilation is adequate.

4 Claims, 4 Drawing Figures

FIG. 1
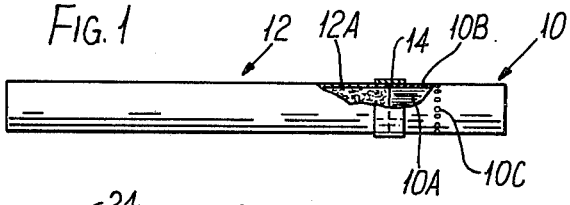
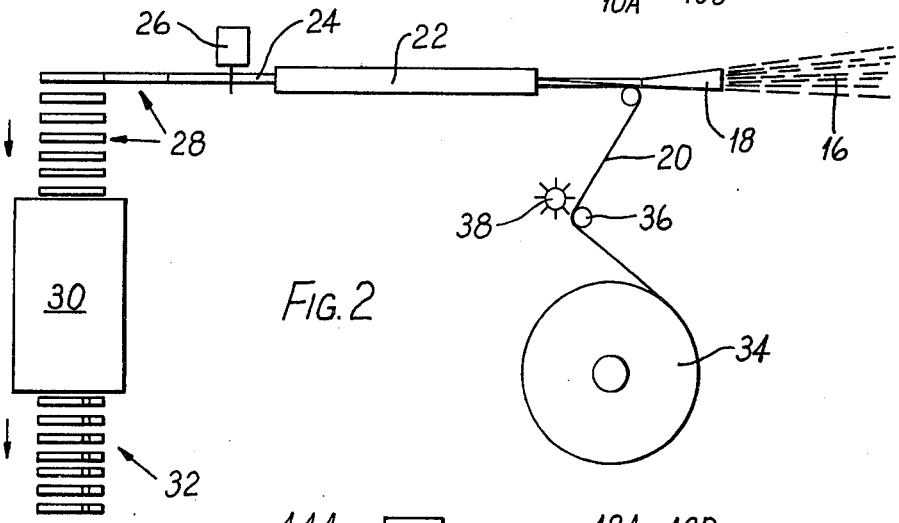
FIG. 2
FIG. 3
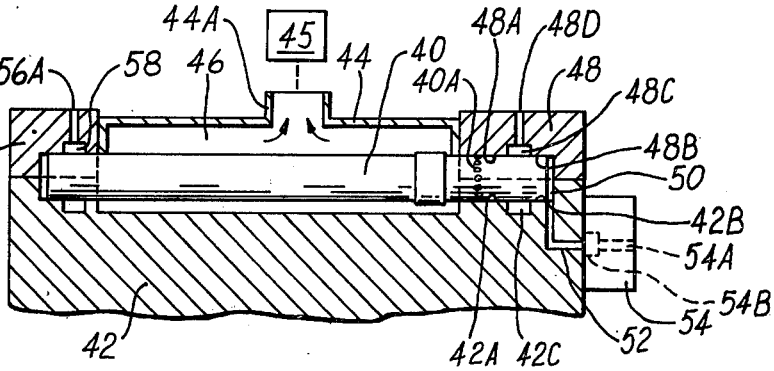
FIG. 4.
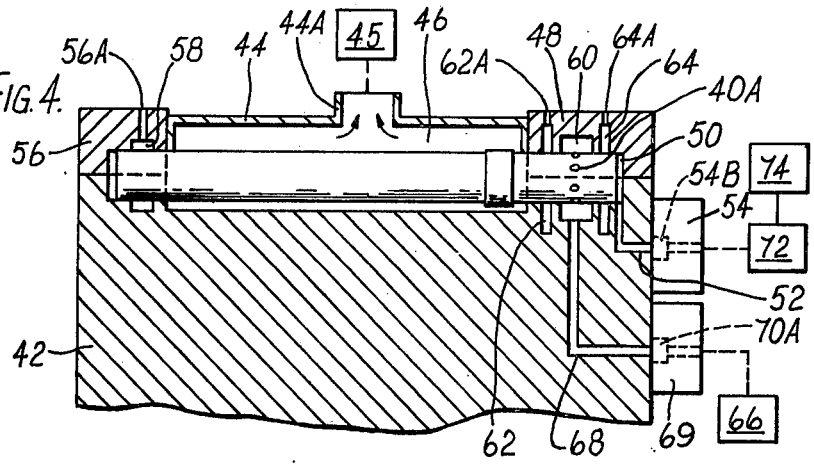

CIGARETTE TESTING

This invention is concerned with what may be termed "ventilated cigarettes", that is to say cigarettes (especially filter-tipped cigarettes) provided with a deliberate leakage path through the wrapper near the mouth end of the cigarette. Air from the atmosphere flows in through the leakage path while the smoker is drawing on the cigarette. This air flow dilutes the smoke which is drawn in by the smoker.

In this context the term "tobacco" is intended to include all smokable materials which may be used in cigarettes, for example artificial tobacco or mixtures of natural and artificial tobacco.

One aspect of this invention is concerned with a method of making ventilated filter-tipped cigarettes in which the filters are made by enclosing a stream of filter material in a continuous wrapper web to form a continuous filter rod which is then cut into separate rods, and in which tobacco-filled rods are then joined to portions of the filter rod by means of uniting bands. The method is characterised in that the continuous wrapper web is formed, at least at longitudinally spaced portions, with perforations or semi-perforations to allow a significant air flow into the filters of the finished cigarettes, and that the uniting bands are only wide enough to surround the abutting ends of the tobacco-filled rods and filter rod portions, and do not cover the perforated or semi-perforated area of the filter wrapping.

The continuous rod may initially be cut into separate rods having a length equal to, for example, four times or six times the length of the filter portion which is subsequently secured to each tobacco-filled rod. The separate rods would in this case be cut subsequently into individual filter portions, e.g. in a filter-attachment machine.

The stream of filter material could be a stream (e.g. of cellulose acetate filter tow) of uniform composition and diameter. Another possibility is that the stream of filter material could be in the form of a rod of cyclically varying cross-section, e.g. as described in British patent specification No. 1,369,437. Another possibility is that the stream could comprise a succession of filter elements of different materials, to form multiple filters in a well known manner.

The wrapper web used to make the filter rod may have a high porosity which is substantially uniform along the length of the wrapper. For example, conventional wrapper web material may be used and may be perforated by a sparking process (e.g. as described in U.S. Pat. No. 3,475,591) upstream of the rod-forming device. Alternatively, specially prepared high-porosity web material may be used.

In a preferred method, however, the wrapper web is perforated or semi-perforated at longitudinally spaced positions while it is being fed towards a rod-forming device in which it is wrapped around the stream of filter material. For example, it may be perforated by sparking; another possibility is the use of pins which either pierce the wrapper web (to form perforations) or scrape away or otherwise remove part of the thickness of the web to form semi-perforations.

According to another aspect of this invention, apparatus for making ventilated filter-tipped cigarettes comprises a rod-forming device for enclosing a stream of filter material in a continuous wrapper web to form a continuous filter rod, means for cutting the continuous filter rod into separate rods, and a filter assembly device for joining portions of the filter rod to tobacco-filled rods by means of uniting bands, characterised by means for perforating or semi-perforating the wrapper web, at least at longitudinally spaced positions, to allow a significant air flow into the filter of the finished cigarettes, and in that the filter-assembly device is arranged to operate with uniting bands which are only wide enough to surround the abutting ends of the tobacco-filled rods and filter rod portions, and which do not cover the perforated or semi-perforated areas of the filter wrapping.

Another aspect of the invention concerns apparatus for testing ventilated cigarettes which include a circumferentially extending row of perforations in the wrapper of the cigarette near the mouth end of the cigarette. The apparatus comprises means defining a perforation testing space around the perforations of each cigarette in turn during a first test period, means for producing a difference in pressure between the annular test space and the interior of the cigarette during the first test period, means operative during a second test period for producing a difference in pressure between the interior of the cigarette and a second space around the cigarette which is separate from the perforation testing space, detector means for detecting the air flow through the wrapper of the cigarette during the first and second test periods, and means for producing a fault signal if the air flow during the first test period is below a first limit and if the air flow during the second test period is above a second limit.

Examples of cigarettes, manufacturing processes and manufacturing and testing apparatus according to this invention are shown in the accompanying drawings. In these drawings:

FIG. 1 is a partly sectioned side elevation of a cigarette constructed and made according to this invention;

FIG. 2 is a schematic view showing apparatus for making one form of cigarette according to this invention;

FIG. 3 shows apparatus for testing cigarettes according to this invention; and

FIG. 4 shows a modification of the testing apparatus shown in FIG. 3.

The cigarette shown in FIG. 1 comprises a filter rod portion 10 and a tobacco-filled rod 12 joined together by a uniting band 14 of paper. The filter rod section includes filter material 10A and a wrapper 10B which is formed with a circumferentially extending row of perforations 10C. The tobacco-filled section includes a wrapper 12A.

It should be noted that the perforations 10C are intermediate the ends of the filter rod section 10 and that the uniting band is wide enough to surround the abutting ends of the rods but does not cover the perforations 10C.

As an alternative, the wrapper 10B of the filter rod section 10 could be uniformly porous so as to provide the ventilation path for air from the atmosphere to flow into the filter.

FIG. 2 shows schematically how the cigarette of FIG. 1 may be made. A stream 16 of filter material, for example in the form of a cellulose acetate tow, is fed through a funnel 18 and onto a continuous wrapper web 20. The web 20 and the filter material then pass into a rod-forming device 22 in which the web is wrapped and secured around the filter material to form a continuous filter rod 24. This rod 24 is cut at regular intervals by a cutting mechanism 26 to produce a succession of filter rods 28. These rods are then deflected sideways and are delivered to a filter-attachment machine 30.

Each of the filter rods 28 comprises, for example, four or six individual filter rod portions. In the filter attachment machine 30, the rods are cut into four or six sections, as the case may be, and each of these portions is joined to a tobacco-filled rod. A stream of filter-tipped cigarettes 32 such as the cigarette shown in FIG. 1 is delivered by the filter-attachment machine 30.

The filter attachment machine may, for example, be as described in our British patent application No. 21365/75 (and corresponding German Offenlegungschrift No. 2622449) to which reference is directed in its entirety.

The wrapper web 20 is drawn from a reel 34 and passes around a guide pulley 36 on its way to the rod-forming device 22. Adjacent to the pulley 36 there is a wheel 38 formed with a number of circumferentially-spaced axially-extending rows of pins. These pins perforate or semi-perforate the web 20 at regular intervals. The cutting mechanism 26 is timed relative to the wheel 38 so as to cut the continuous rod at appropriate positions in relation to the rows of perforations.

As an alternative to the perforating arrangement, there may be a sparking device for perforating the web 20 either continuously or at regular intervals.

FIG. 3 is a section through a test drum by which the cigarettes can be tested to ensure that there is no excessive leak in the wrapper (aside from the deliberate leakage perforations) such as can result from an imperfect longitudinal seam in the wrapper of the tobacco rod, a hole in the tobacco wrapper or imperfect adhesion of the uniting band to the tobacco or filter rod.

The cigarette testing apparatus shown in FIG. 3 operates basically in accordance with the invention described in our British patent specification No. 1,195,682. The cigarettes 40 are carried during testing by a drum 42. Extending around part of the drum there is a fixed housing 44 which defines, with the drum, a suction chamber 46 extending around each cigarette during testing; the chamber 46 communicates with a source of suction 45 through an inlet 44A.

Each cigarette at its filter end rests in a semi-cylindrical flute in the drum formed by two portions 42A and 42B separated by an annular groove 42C. A seal around the cigarette is completed by a movable end cap 48 which has similar flute sections 48A and 48B separated by an annular groove 48C which lines up with the groove 42C in the drum to form an annular space around the cigarette. This space is vented to atmosphere through a passage 48D, thus completely isolating the suction space 46 from a space 50 adjacent to the end of the cigarette.

During the testing of each cigarette a suction pressure is created in the space 50 and indicates the degree of leakage of air through the wrapper of the cigarette in the region contained within the suction space 46. A passage 52 in the drum leads to an end face of the drum against which a fixed pad 52 is in sealing engagement. A passage 54A in the pad communicates with an arcuate slot 54B in the face of the pad which communicates with each passage 52 in turn during testing. Passage 54 and is connected to a pressure detector (not shown), for example a diaphragm transducer, from which an electrical signal can be obtained which is indicative of the leakage through the cigarette.

The flute sections 42A and 48A respectively in the drum and cap surround a circumferentially extending row of ventilation perforations 40A in the cigarette. These flute sections are a close fit around the cigarette, so that substantially no air flows through the perforations 40A during testing.

At the other end of the cigarette a movable cap 56 similarly defines a seal around the cigarette with an annular space 58 which is vented to atmosphere through a passage 56A.

The caps 48 and 56 seal off the ends of the suction space 46 around the cigarette. The caps may be pivotally mounted, as described in British patent specification No. 1,195,682 or may be linearly movable as described in our British patent application No. 4464/74 (and German Offenlegungschrift No. 2,503,857) to which reference is directed in its entirety.

There is preferably a leakage path to atmosphere from the end space 50. This may be provided by a passage extending to atmosphere from the passage 52, or may be provided by forming the flute portions 42B and 48B slightly larger in diameter than the cigarette so as to provide limited communication between the end space 50 and the atmospheric space 48C.

FIG. 4 shows a modification of part of the testing apparatus shown in FIG. 3. Similar or equivalent parts have the same reference numerals as in FIG. 3.

In the apparatus shown in FIG. 4, instead of the perforations 40A in the filter wrapper being closed during testing by close-fitting flute sections of the drum and cap, the drum and cap together form a perforation testing space 60 surrounding the perforations 40A; the perforations are in this case closer to the mouth end (the right-hand end) of the cigarette. On opposite sides of the annular space 60 the drum 42 and cap 48 are formed with cooperating grooves forming two annular spaces 62 and 64 which are vented to atmosphere by openings 62A and 64A respectively.

During a first test period, a source of suction 66 (which may be common with the source 45) is connected to the perforation test space 60 via a passage 68 and a second fixed pad 70. This pad 70 has a short arcuate slot 70A which connects the passage 68 to the suction source 66 only for part of the time during which the arcuate slot 54B (which is longer) connects the end space 50 for each cigarette to a pressure detector 72. Thus for part of the total testing cycle for each cigarette the suction pressure detected by the detector 72 is dependent upon air flow through substantially the whole wrapper of the cigarette, including the perforations 40A, this being the "first test period"; during the second test period the passage 68 is closed by the pad 69 so as to be isolated both from the atmosphere and from the suction source, and during this second period the detector 72 will sense a suction pressure which is indicative of the leakage flow through the part of the wrapper of the cigarette which lies within the suction space 46.

The detector 72 may transmit an electrical output signal to an electronic comparator circuit 74 (of a known kind) which produces a fault signal if the suction pressure received by the detector 72 during the first test period is too low (indicating inadequate ventilation of the cigarette) or if the suction pressure received during the second test period is too great. The first and second test periods for each cigarette may occur in either order.

The apparatus shown in FIG. 3 or FIG. 4 may be replaced by apparatus basically as described in our British patent specification No. 1,036,889, especially in FIG. 4. That is to say, the suction chamber and the end seals around each cigarette during testing may be defined by two cooperating conveyors.

Cigarettes according to this invention may also be tested using a modified form of the test apparatus described in our British patent application No. 2592/74 (and German OLS No. 2,502,120). The modification consists of extending one side of the belt 38 and the part 23 of the drum carrying the cigarettes, so as to close the perforations in the filter rod section of the cigarettes during testing, as shown in FIG. 3 of the present application.

We claim:

1. Apparatus for testing ventilated cigarettes which include a circumferentially extending row of perforations in the wrapper of the cigarette near the mouth end of the cigarette, comprising means defining a perforation testing space around the perforations of each cigarette in turn during a first test period, means for producing a difference in pressure between the test space and the interior of the cigarette during the first test period, means operative during a second test period for producing a difference in pressure between the interior of the cigarette and a second space around the cigarette which is separate from the perforation testing space, detector means for detecting the air flow through the wrapper of the cigarette during the first and second test periods, and means for producing a fault signal if the air flow during the first test period is below a first limit and if the air flow during the second test period is above a second limit.

2. Apparatus according to claim 1 in which the test space is formed around the perforations of each cigarette during both test periods but is isolated during the second test period so that the air flow during the second test period is indicative of leakage through a part of the cigarette which does not include the row of perforations.

3. Apparatus according to claim 2 in which the second space around the cigarette is defined by a housing and is arranged to communicate with a source of suction pressure during the second test period, the perforation testing space being arranged to communicate with a source of suction pressure during the first test period.

4. Apparatus according to claim 3 in which the detector means comprises a pressure detector which communicates with a space at the mouth end of each cigarette in turn during both test periods.

* * * * *